US007048623B2

(12) United States Patent
Perkitny

(10) Patent No.: US 7,048,623 B2
(45) Date of Patent: May 23, 2006

(54) COIN SEPARATOR AND SORTER ASSEMBLY

(75) Inventor: Jerzy Perkitny, Lakewood, OH (US)

(73) Assignee: Mag-Nif Incorporated, Mentor, OH (US)

( * ) Notice: Subject to any disclaimer, the term of this patent is extended or adjusted under 35 U.S.C. 154(b) by 731 days.

(21) Appl. No.: 09/780,826

(22) Filed: Feb. 9, 2001

(65) Prior Publication Data

US 2002/0111130 A1 Aug. 15, 2002

(51) Int. Cl.
*G07D 3/00* (2006.01)

(52) U.S. Cl. ..... 453/13; 453/12; 453/33; 194/334; 194/338; 232/57; 232/60

(58) Field of Classification Search ..... 463/10, 463/6, 12, 13, 33, 34, 35, 49, 57; 194/334, 194/335, 336, 337, 338; 453/6, 10, 12, 13, 453/33–35, 49, 57; 232/55, 57, 60, 61
See application file for complete search history.

(56) References Cited

U.S. PATENT DOCUMENTS

| | | | | | |
|---|---|---|---|---|---|
| 811,559 | A | * | 2/1906 | Hess | 453/13 |
| 915,965 | A | * | 3/1909 | Johnson | 453/13 |
| 1,433,943 | A | | 10/1922 | Doldt | |
| 1,533,244 | A | * | 4/1925 | Godefroid | 453/13 |
| 1,749,421 | A | * | 3/1930 | Donnellan | 453/13 |
| 1,819,235 | A | * | 8/1931 | Donnellan | 453/31 |
| 1,895,975 | A | * | 1/1933 | Carruthers et al. | 453/13 |
| 1,927,265 | A | * | 9/1933 | Hume | 453/13 |
| 1,947,456 | A | * | 2/1934 | Bock | 453/13 |
| 2,080,389 | A | * | 5/1937 | Rasmusen et al. | 453/13 |
| 2,110,014 | A | * | 3/1938 | Donnellan | 453/12 |
| 2,348,936 | A | * | 5/1944 | Sprenger | 453/12 |
| 2,680,516 | A | | 6/1954 | Schuitema | |
| 3,143,118 | A | * | 8/1964 | Haines | 453/13 |
| 3,173,431 | A | * | 3/1965 | Chichester et al. | 453/12 |
| 3,242,931 | A | | 3/1966 | Wandrey | |
| 3,583,410 | A | * | 6/1971 | Bayha et al. | 453/20 |
| 4,059,122 | A | * | 11/1977 | Kinoshita | 453/3 |
| 4,304,247 | A | | 12/1981 | Hasegawa | |
| 4,407,312 | A | * | 10/1983 | Davila et al. | 453/32 |

(Continued)

FOREIGN PATENT DOCUMENTS

DE 226 166 9/1910

(Continued)

OTHER PUBLICATIONS

Mag-Nif makes it in the U.S.A.! 1999 Brochure, front and back cover pages and pp. 1-16.

*Primary Examiner*—Donald P. Walsh
*Assistant Examiner*—Jeffrey A. Shapiro
(74) *Attorney, Agent, or Firm*—Fay, Sharpe, Fagan, Minnich & McKee, LLP

(57) ABSTRACT

A coin sorting apparatus includes a coin hopper and a coin ramp positioned below the coin hopper. A coin separator mechanism is located between the coin hopper and the coin ramp. The coin separator mechanism includes a separating wheel having a plurality of coin receiving apertures and a wheel housing which supports the separating wheel. The wheel housing includes a set of apertures arranged in order of increasing size for sorting the coins by diameter. A coin support surface is provided on one of the separating wheel and the wheel housing and a coin rolling surface is defined on the wheel housing.

53 Claims, 14 Drawing Sheets

U.S. PATENT DOCUMENTS 4,598,724 A * 7/1986 Boland ..... 453/32
4,881,919 A * 11/1989 Dabrowski ..... 453/57
4,987,990 A 1/1991 Perkitny
4,995,848 A 2/1991 Goh
5,122,094 A * 6/1992 Abe ..... 453/57
5,232,399 A 8/1993 Le Hong et al.
5,326,312 A * 7/1994 Patroni ..... 453/57
5,474,496 A 12/1995 Perkitny
5,531,640 A * 7/1996 Inoue ..... 453/17
5,551,542 A * 9/1996 Stockli ..... 194/334
5,827,117 A 10/1998 Naas
5,902,178 A * 5/1999 Perkitny ..... 453/9
5,924,919 A * 7/1999 Hirano ..... 453/57
6,029,794 A * 2/2000 Tamaki ..... 194/338
6,080,056 A * 6/2000 Karlsson ..... 453/3
6,095,916 A * 8/2000 Tamaki ..... 453/57
6,099,401 A 8/2000 Perkitny
6,165,064 A * 12/2000 Aurelius et al. ..... 453/18
6,193,598 B1 * 2/2001 Tsuchida ..... 453/57
6,220,954 B1 * 4/2001 Nguyen et al. ..... 453/57
6,319,126 B1 * 11/2001 Tamaki ..... 463/25
6,383,070 B1 * 5/2002 Tamaki ..... 453/57

FOREIGN PATENT DOCUMENTS

GB 412052 6/1934
GB 706981 4/1954
GB 914652 1/1963
GB 2 130 779 6/1984
JP 03088093 A * 4/1991 ..... 453/13

* cited by examiner

COIN SEPARATOR AND SORTER ASSEMBLY

BACKGROUND OF THE INVENTION

The present invention relates to coin banks. More particularly, the present invention relates to a very accurate coin separating and sorting assembly for a coin bank, the assembly being able to sort all of a country's coins currently in widespread use. For the United States, such coins are the penny, nickel, dime, quarter and dollar coins.

Coin banks are generally known. A user places one or more coins in a hopper or similar coin receiving location. A coin separating mechanism separates the coins and moves them, hopefully one at a time, into a coin sorting mechanism. The coin sorting mechanism classifies the coins by their diameter. Coins of a particular diameter, and consequently of a particular denomination, are directed into the appropriate one of a plurality of sorted coin storage containers.

Coin separating mechanisms employing rotating coin separator plates are known. One known such separator plate is in the form of a disk having four U-shaped notches formed in its periphery. Each notch is sized to be larger in width than the largest coin which is to be sorted by the coin sorter. The separator plate is mounted on a planar base of a receiver, the base being fixed to an upper housing at a slope of approximately 45° from the horizontal. Coins tend to come to rest in the lowermost portion of the receiver with their faces contacting the separator plate or the base. When the separator plate is rotated, it will engage a coin with the edge of one of its notches and carry it upward to an opening formed in the base where the coin will fall through into an upper portion of a coin ramp leading to the sorting ramp. The ramp has apertures of increasing size through which the coins fall into sorted coin containers. The thickness of the sorter plate is chosen to be less than or equal to the thickness of the thinnest coin to be sorted so that only one coin at a time is engaged by each notch. However, this known coin separating mechanism does not employ a separator plate which delivers pre-oriented coins to a sorter. Nor does it perform its separating and sorting functions in a minimum of space. Also this known coin separating mechanism is not designed to handle dollar coins.

Accordingly, it is desirable to develop a new and improved coin separator and sorter assembly which would overcome the foregoing deficiencies and others as well as providing better and more advantageous overall results.

BRIEF SUMMARY OF THE INVENTION

According to one aspect of the present invention, a coin bank is provided.

More particularly, in accordance with this aspect of the invention, the coin bank comprises a coin hopper, a coin slide positioned below the coin hopper and a coin separating and sorting assembly located between the coin hopper and the coin slide. The coin separating and sorting assembly comprises a separating wheel including at least one coin receiving aperture, with a toroidal flange extending away from a face of the coin separating wheel, and a wheel housing on which the separating wheel is supported. The wheel housing includes a toroidal channel in which the toroidal flange of the separating wheel is accommodated.

According to another aspect of the present invention, a coin separating and assorting assembly is provided.

More particularly, in accordance with this aspect of the invention, the assembly comprises a separating wheel including at least one coin receiving aperture and a wheel housing on which the separating wheel is supported. The wheel housing comprises at least one aperture which is sized to allow passage of a coin of a defined maximum diameter therethrough. A coin support surface is provided on one of the separating wheel and the wheel housing. A coin rolling surface is defined on one of the separating wheel and the wheel housing.

In accordance with still another aspect of the present invention, a coin separating and sorting assembly is provided.

More particularly in accordance with this aspect of the present invention, the assembly comprises a separating wheel including at least one coin receiving aperture located in a wall of the separating wheel. A wheel housing is provided on which the separating wheel is supported. A coin support surface is provided on one of the separating wheel and the wheel housing for supporting a portion of an associated coin being moved by the separating wheel in relation to the wheel housing. A coin rolling surface is defined on one of the separating wheel and the wheel housing.

BRIEF DESCRIPTION OF THE DRAWINGS

The invention may take form in certain components and structures, several embodiments of which will be illustrated in the accompanying drawings and wherein.

DETAILED DESCRIPTION OF THE SEVERAL EMBODIMENTS

Figure 1A:
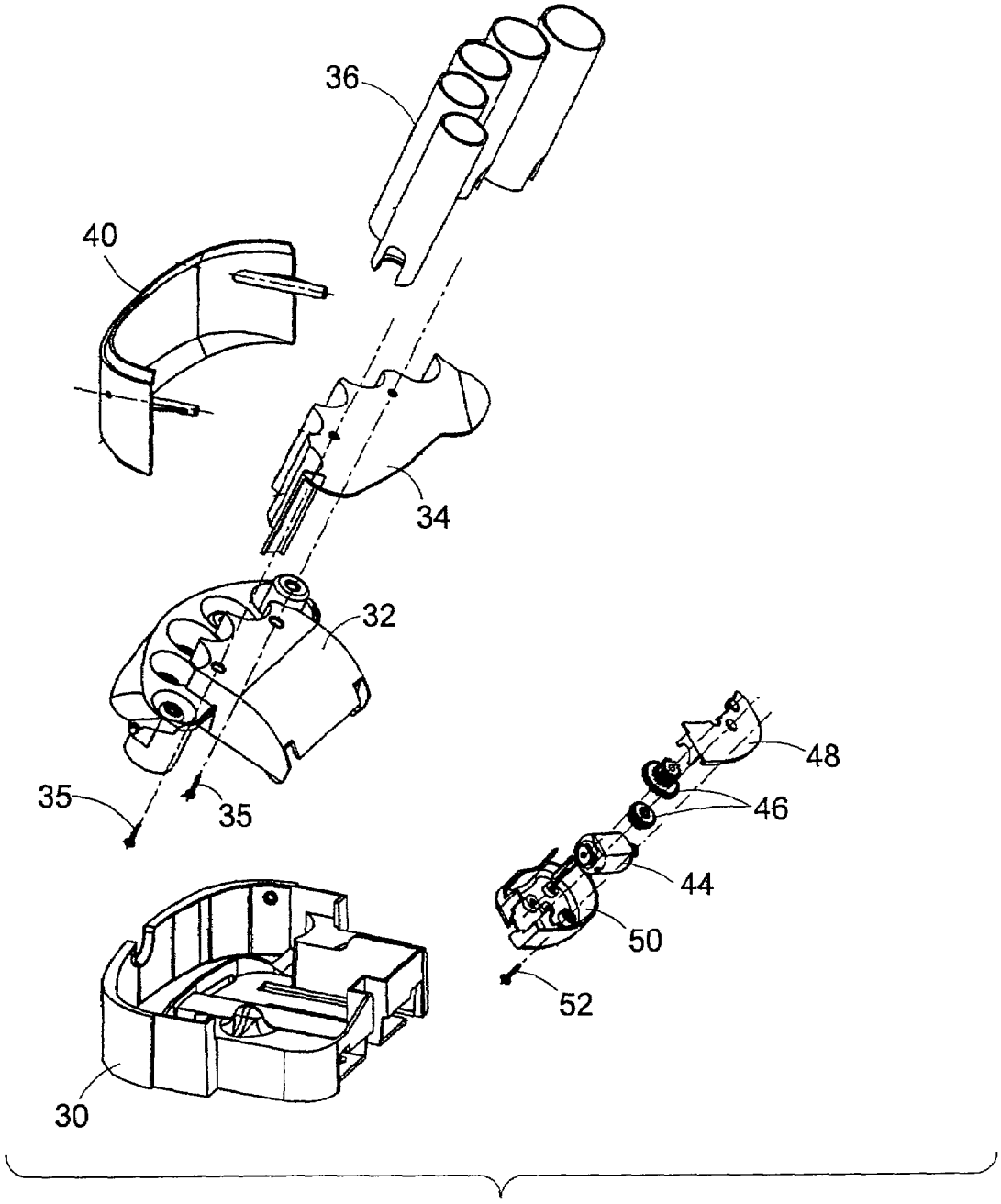
FIG. 1A is an exploded perspective view of a first portion of a coin bank according to a first embodiment of the present invention.

Referring now to the drawings, wherein the showings are for purposes of illustrating several embodiments of the invention only and not for purposes of limiting same, the Figures show a coin separating and sorting assembly as employed in one type of coin bank. Of course, it should be appreciated that the coin separating and sorting assembly could be used in a variety of different coin banks.

Figure 1B:
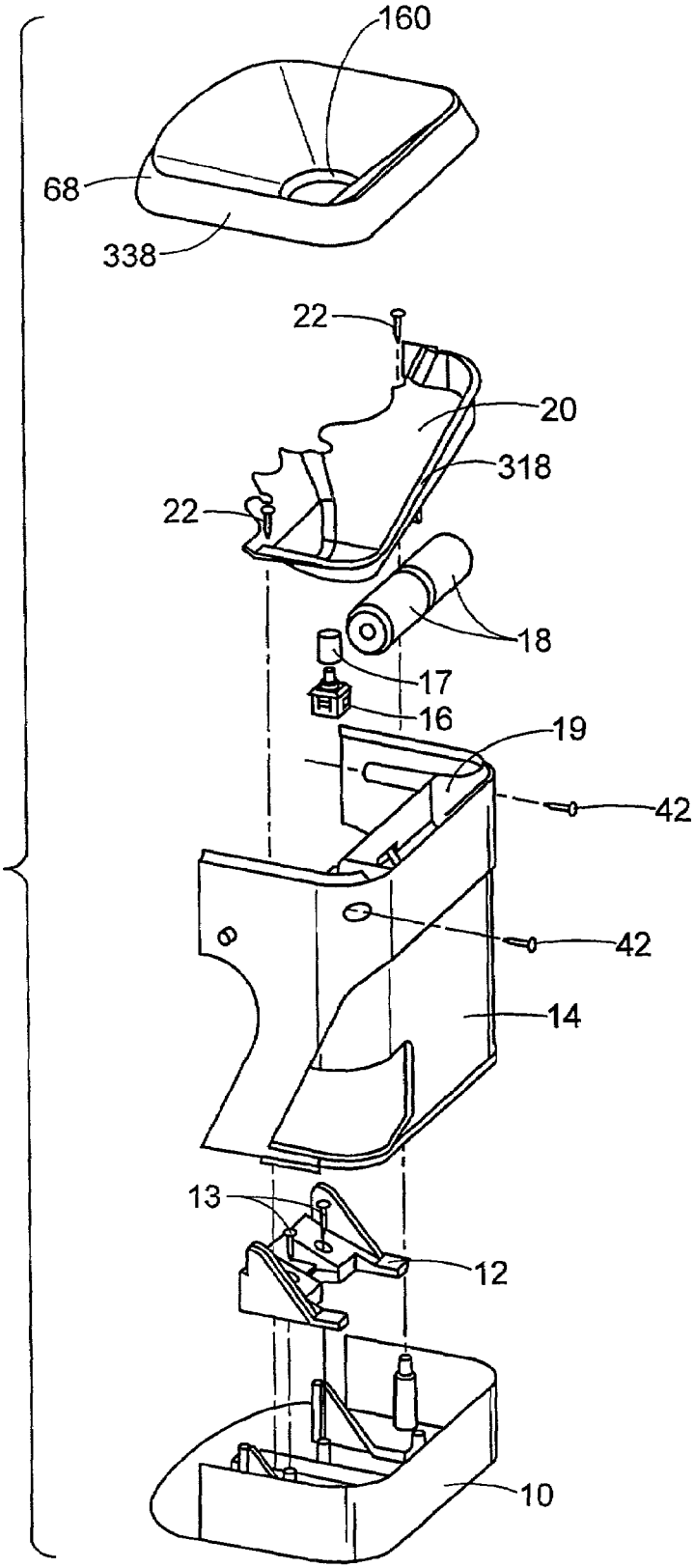
FIG. 1B is an exploded perspective view of a second portion of the coin bank according to the first embodiment of the present invention.
Figure 1C:
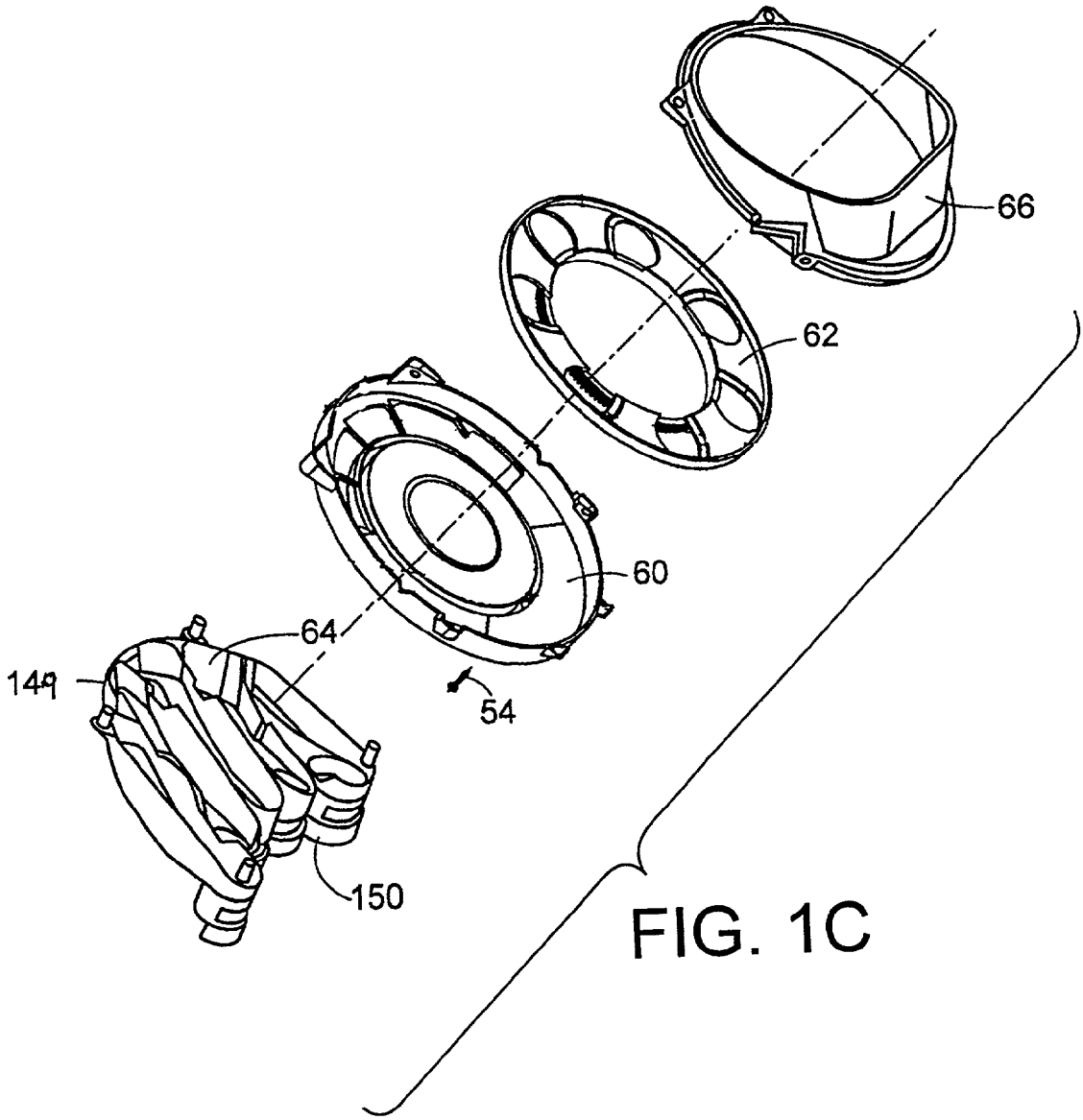
FIG. 1C is an exploded perspective view of a third portion of the coin bank according to the first embodiment of the present invention.

With reference now to FIG. 1B, the coin bank according to the present invention comprises a base 10 on which is positioned a ramp 12. The ramp is preferably secured to the base by suitable fasteners 13. Mounted on the base 10 is a back housing 14. Secured to the back housing is a switch 16 to which is connected an activation button 17. One or more batteries 18 can be mounted in a battery housing compartment 19 formed in the back housing 14. A coin overflow compartment 20 can be mounted on the base 10 via suitable fasteners 22.

With reference now also to FIG. 1A, slidably mounted in the base 10 is a drawer 30. Housed in the drawer 30 is a coin tube base 32 having a rear support wall 34 which is secured to the coin tube base 32 by suitable fasteners 35. Several coin tubes 36, one for each denomination of coins meant to be sorted, are selectively mounted on the coin tube base 32 and are supported by the support wall 34 which has suitably shaped indentations for that purpose. A front wall 40 of the apparatus is mounted to the back housing 14 by suitable fasteners 42 (FIG. 1B). The front wall 40 is located above the drawer 30 and is spaced therefrom by the length of the coin tubes 36. A motor 44 of the apparatus has an output shaft (not visible in FIG. 1A) connected to a gear train having a plurality of gears 46. The motor 44 and the gears 46 are mounted in a housing assembly having an upper housing portion 48 and a lower housing portion 50, which are secured together by a fastener 52.

Suitable fasteners 54 are employed to mount a wheel housing 60 in place in the apparatus. The motor housing halves 48 and 50 are secured by the fastener 52 to a lower face of the wheel housing 60. Mounted on the wheel housing 60 is a separating wheel 62. With reference again to FIG. 1B, positioned beneath the wheel housing 60 and mounted thereto is a coin slide 64. A cover or hopper 66 is mounted above the wheel housing 60. A funnel 68 constitutes a top portion of the coin bank. The funnel is selectively removable from the coin bank to provide access to the separating wheel 62.

Figure 2:
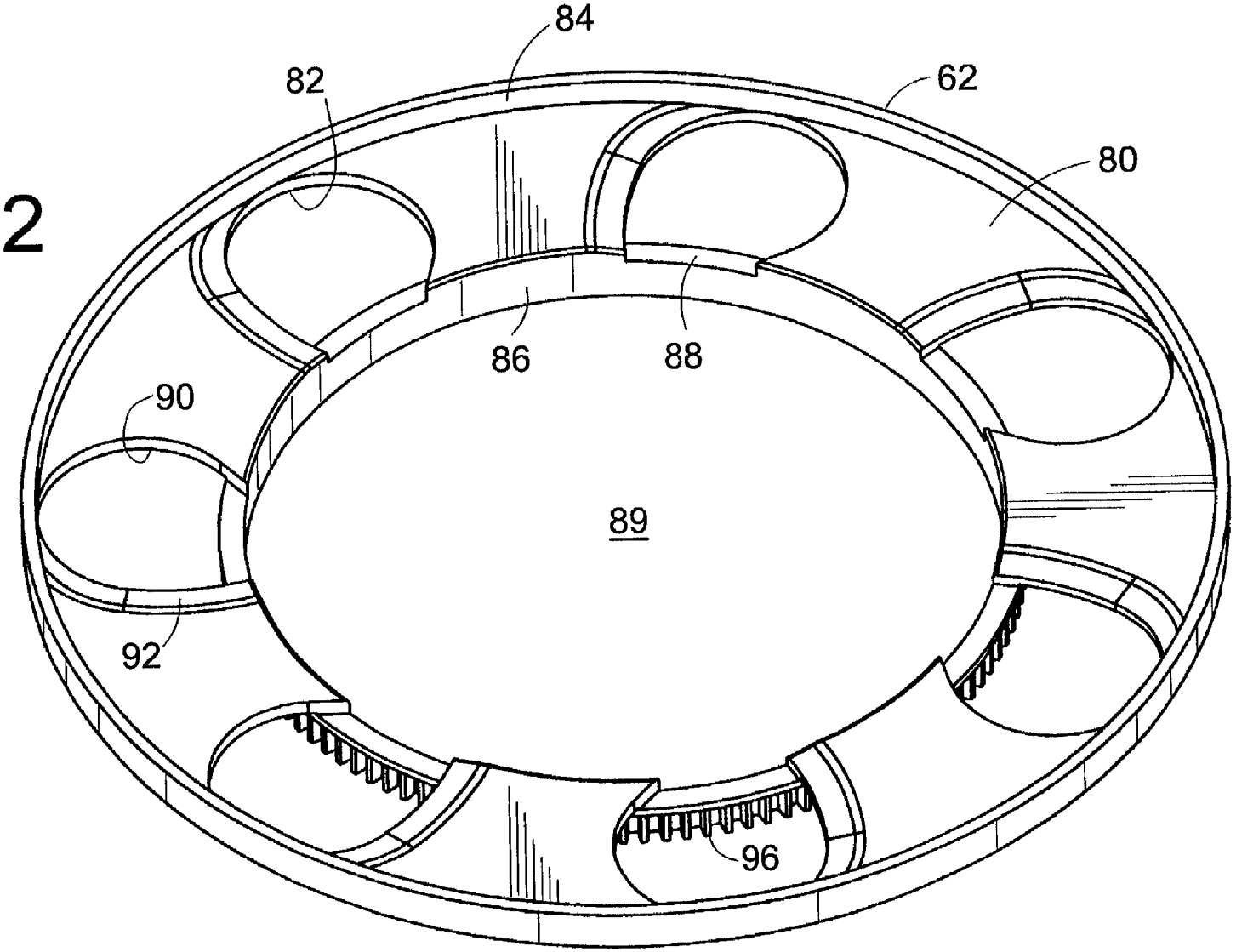
FIG. 2 is an enlarged perspective view from a top side of a separating wheel of the coin bank of FIG. 1.
Figure 3:
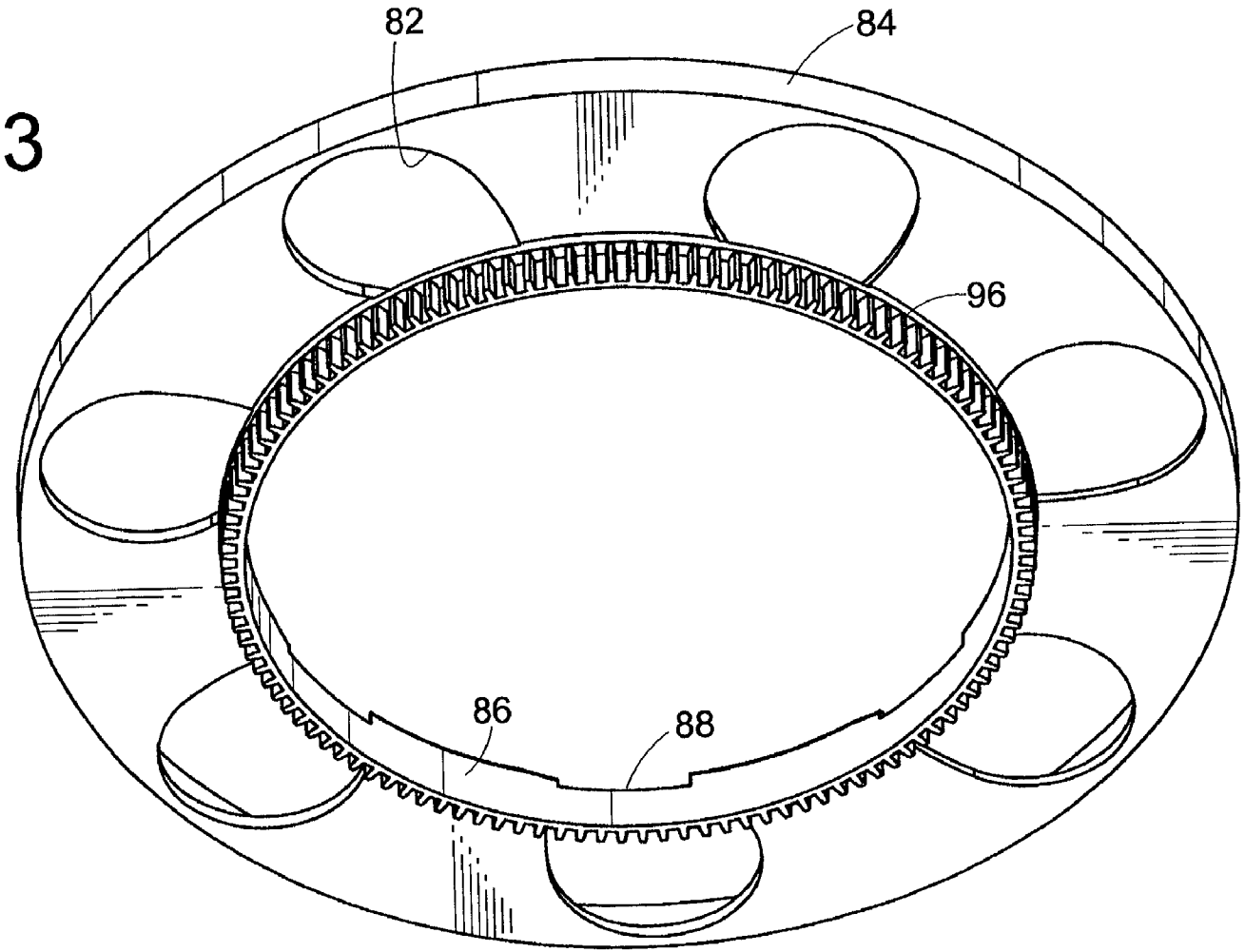
FIG. 3 is a perspective view from a bottom side of the separating wheel of FIG. 2.

With reference now to FIG. 2, the coin separating wheel 62 is toroidal or ring-like and includes a top wall 80 having a plurality of spaced apertures 82 located therein. Each of the apertures extends from an inner periphery of the ring-like sorting wheel 62 to an outer flange 84 thereof. Also provided is an inner flange 86 which depends from the inner periphery of the top wall 80. A set of slots 88 are located in the inner flange 86, each slot opening to a respective one of the apertures 82. The inner flange 86 surrounds an open center portion 89 of the separating wheel. Each of the apertures 82 includes a leading edge 90 and a trailing edge 92. The trailing edge has a tapered surface 94, best illustrated in FIG. 7. With reference now also to FIG. 3, provided on an outer surface of the inner flange 86 is a set of gear teeth 96.

Figure 8:
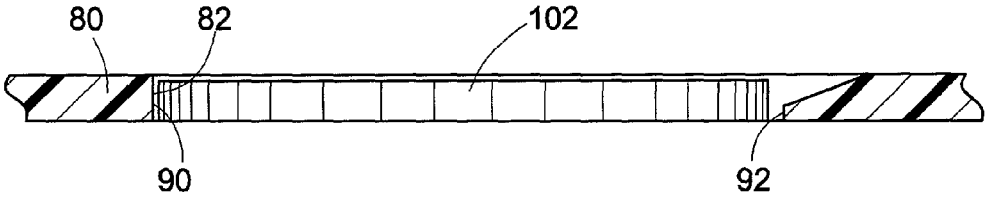
FIG. 8 is a greatly enlarged side elevational view in partial section of a portion of the separating wheel of FIG. 2 when a largest one of the coins meant to be sorted is accommodated in an aperture.

With reference now to FIG. 8, each aperture 82 is sized so as to accommodate the largest diameter coin 102 meant to be sorted. If the coins are United States coins, the largest diameter coin meant to be sorted in the coin sorting apparatus is a Sacajawea or Susan B. Anthony dollar. It should also be apparent from FIG. 8 that the thickness of the top wall 80 is greater than the thickness of the largest diameter coin 102. In United States coinage the largest diameter coin is also the thickest coin, the dollar coin.

The reason why the leading edge of each aperture 82 is thicker than the thickness of the thickest diameter coin being sorted is that it is undesirable if a coin held in the aperture 82 picks up another coin during sorting simply because a top surface of the coin extends out of the aperture. In other words, if the thickest coin being sorted were thicker than is the thickness of the top wall 80, such thicker coin could pick up another coin thereby causing a missorting as the coin would itself act as a picker element, which is meant to be function of the separating wheel.

Figure 7:
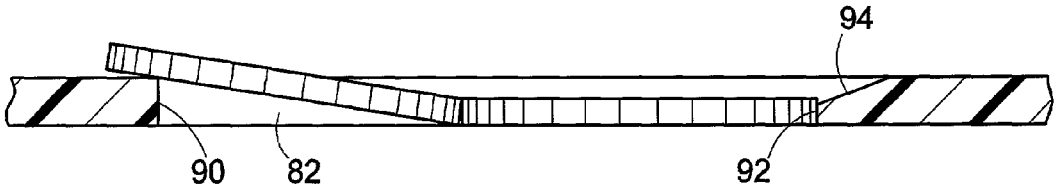
FIG. 7 is a greatly enlarged side elevational view in partial section of a portion of the separating wheel of FIG. 2 when an attempt is made to accommodate two of the smallest diameter coins meant to be sorted in a single aperture.

With reference now to FIG. 7, it is apparent that the trailing edge 92 of each aperture 82 is thinner than is the thickness of the thinnest coin 104 meant to be sorted. If the coin sorter is meant to sort United States currency, then that coin would be a dime. It should also be apparent from FIG. 7 that the size of the aperture 82 is smaller than two such smallest diameter coins 104 positioned side by side. In other words, the apertures 82 will not accommodate two such coins 104 in a side by side manner. Rather, one of the coins will project out of the aperture, as is illustrated in FIG. 7.

Figure 6:
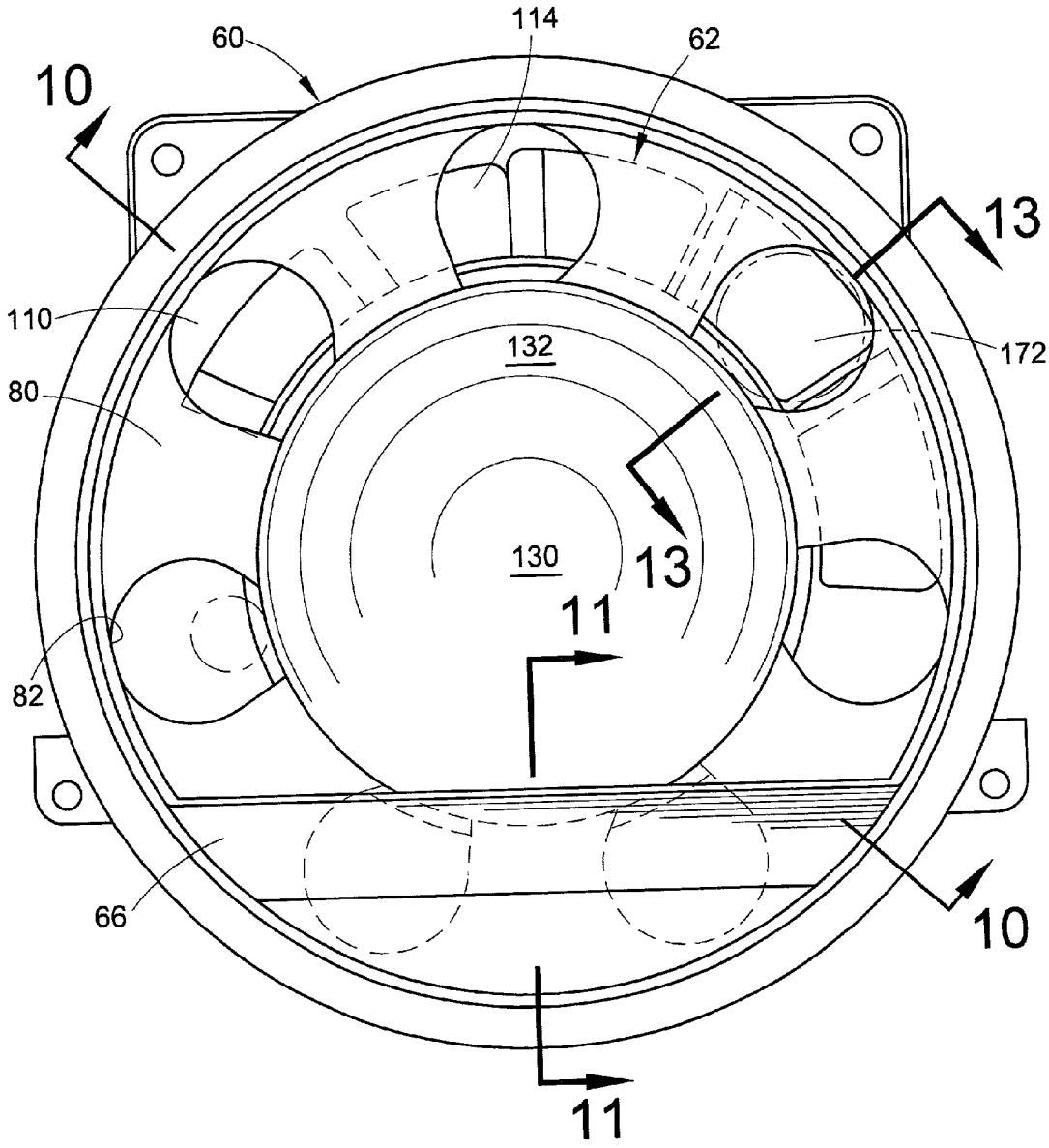
FIG. 6 is an assembled top plan view of a coin separating and sorting assembly of the coin bank of FIGS. 1A and 1B.

It should be apparent from FIG. 2 that the shape of the apertures 82 is asymmetrical. In other words, each aperture 82 is more curved at its leading edge 90 than it is at its trailing edge 92. The more circular leading edge insures that while the aperture is large enough to accommodate the largest diameter coin 102 meant to be sorted, it is not so large as to hold two of even the smallest diameter coins 104 meant to be sorted. Also, the aperture is of suitable dimensions as to cause an inner portion of the largest diameter coin meant to be sorted to protrude through the slot 88, as best illustrated in FIG. 6.

The coins are urged by gravity radially inwardly during rotation of the wheel due to the shape of the aperture 82 and the angle at which the separator wheel 62 is mounted before the coins reach the first aperture in the wheel housing. In other words, the angle at which the separator wheel 62 and wheel housing 60 are oriented in relation to a horizontal plane is large enough to overcome the force of friction and allow the coins to slide radially inwardly on the wheel housing. That angle may be approximately 45°. Configuration of the trailing edge 92 is important in allowing coins to move radially inwardly during rotation of the wheel before the coins reach the first wheel housing aperture.

The radially outermost point of each separator wheel aperture 82 is even with the outer flange 84 and no wall section is located between them. This construction prevents coins at the lowest point of the coin sorter during rotation of the wheel in relation to the wheel housing from getting hung up and not falling completely into an aperture 82. Such a wall section would prevent the coins from being successfully sorted.

Figure 4:
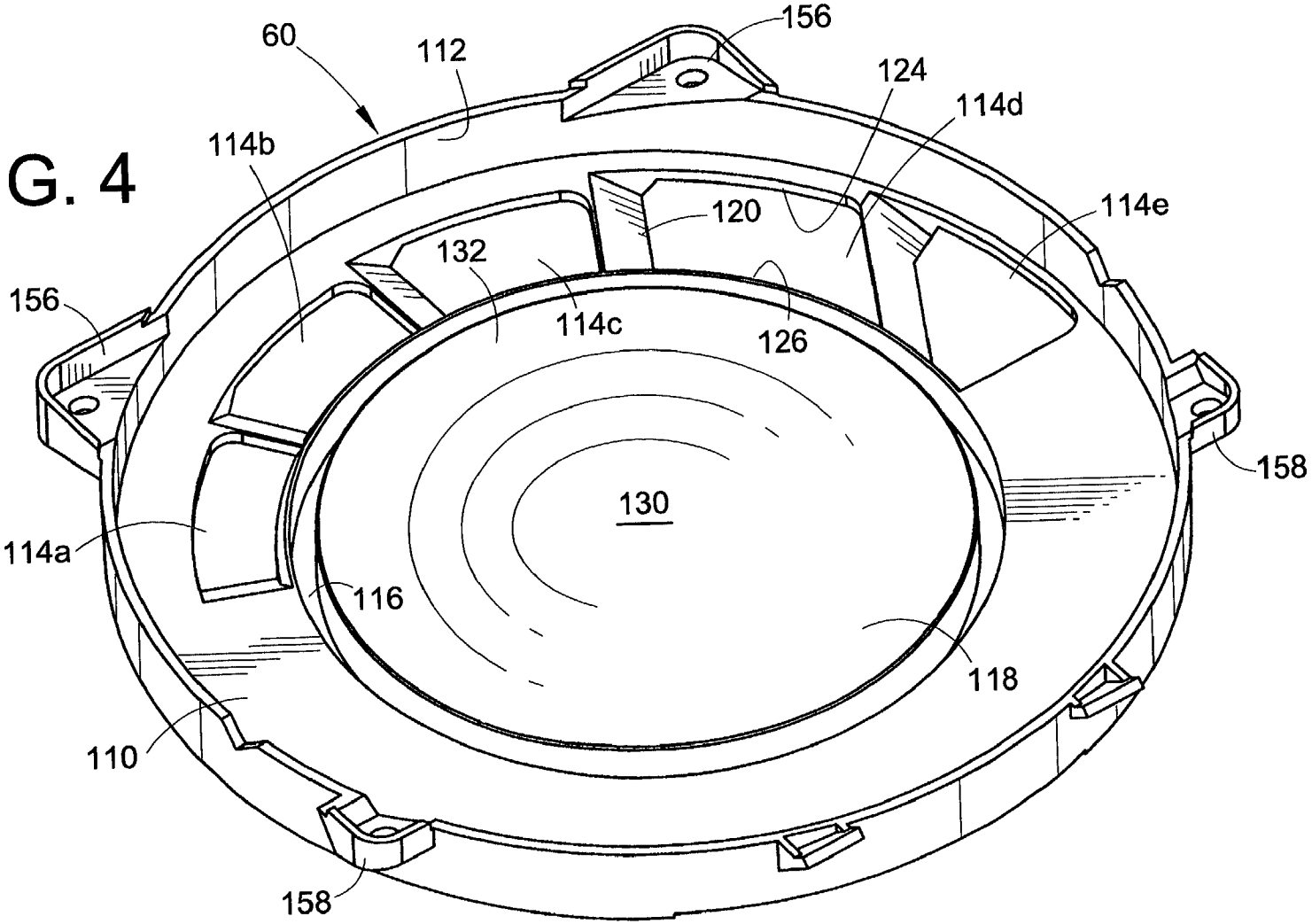
FIG. 4 is an enlarged perspective view from a top side of a wheel housing of the coin bank of FIG. 1.
Figure 5:
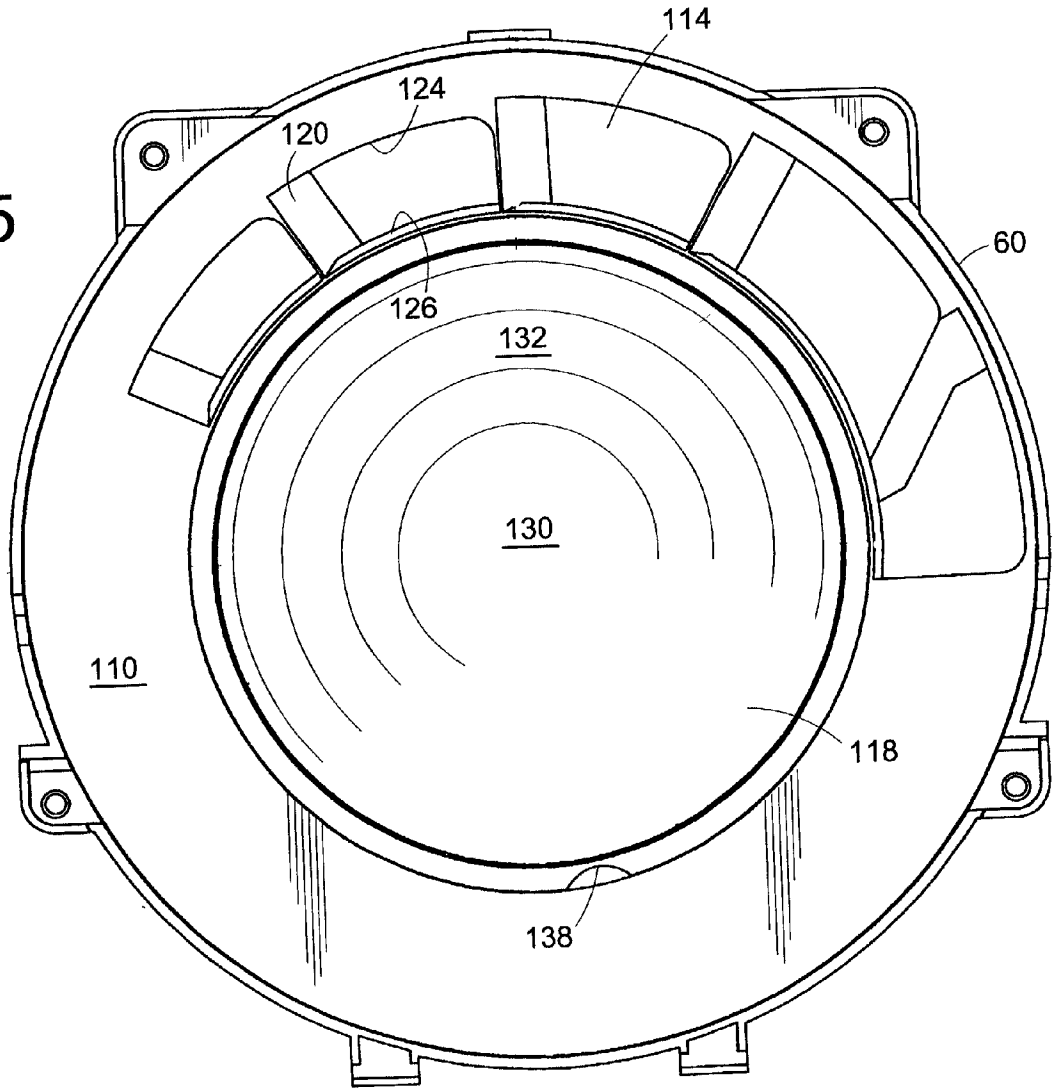
FIG. 5 is a top plan view of the wheel housing of FIG. 4.

With reference now to FIG. 4, the wheel housing 60 comprises an outer wall 110 having an outer skirt 112. Located radially inwardly from the skirt 112 are a series of spaced apertures 114. It is apparent that the apertures are of different sizes such that the apertures increase in width clockwise from a smallest width aperture 114*a* to a largest width aperture 114*e*. Positioned radially inwardly from the set of apertures 114 is a channel shaped groove 116. It is apparent that the groove 116 is ring-like in nature. The groove 116 surrounds a central wall portion 118 of the wheel housing. Each of the apertures 114 can be defined by a tapered rear wall 120 as well as an outer edge 124 and an inner edge 126. It should be apparent from FIG. 5 that while the inner edges 126 for each of the apertures 114 remain at the same radial distance from an axis of the wheel housing 60, the outer edges 124 of the apertures are at a progressively greater distance from the axis of the wheel housing, increasing in a clockwise manner. This allows the apertures to accommodate increasingly larger diameter coins from a smallest diameter coin meant to be sorted being accommodated in aperture 114*a* to a largest diameter coin meant to be sorted being accommodated in aperture 114*e*.

Figures 10, 10A:
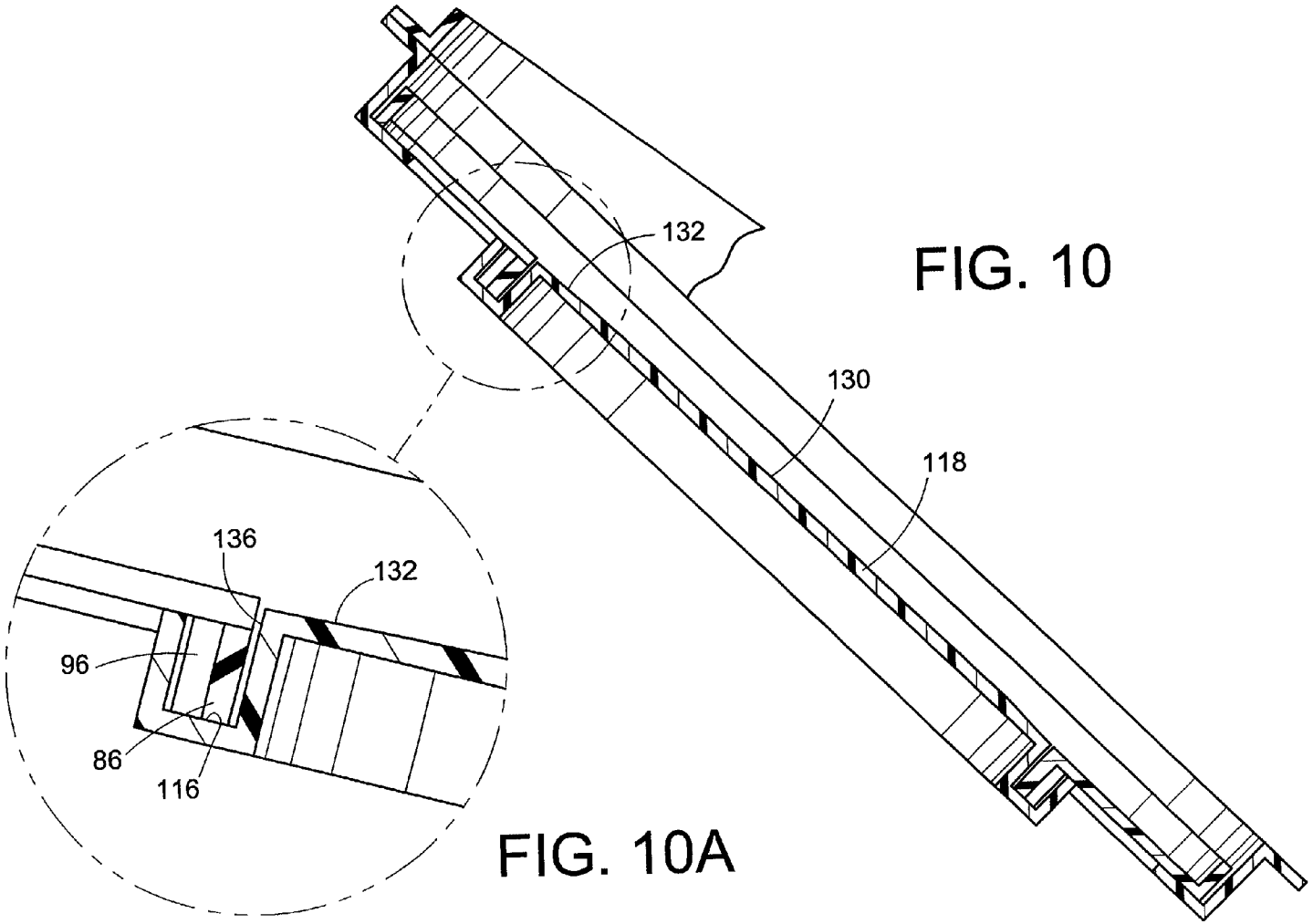
FIG. 10 is a cross-sectional view along line 10—10 of the coin separating and sorting assembly of FIG. 6.
FIG. 10A is an enlarged view of a portion of the coin separating and sorting assembly of FIG. 10.
Figure 11:
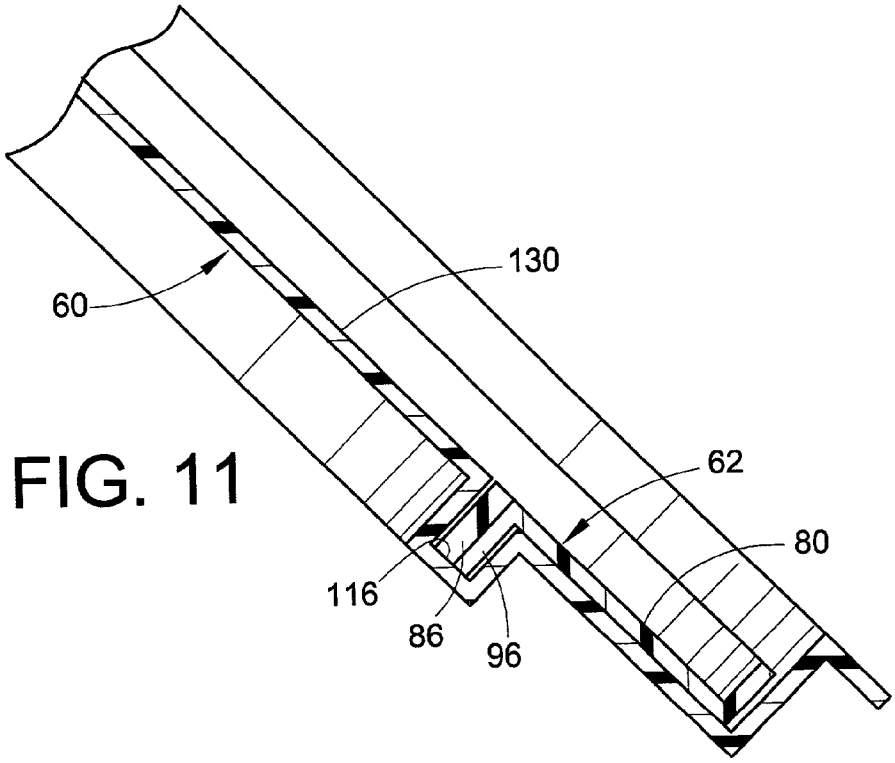
FIG. 11 is an enlarged cross-sectional view along line 11—11 of the coin separating and sorting assembly of FIG. 6.

With reference now to FIG. 10, it should be appreciated that the central wall portion 118 is a plateau 130 with a somewhat C-shaped recessed area 132. The purpose for the recessed area is to allow coins not fitting in an aperture 82 to slide down in the direction of arrow 134. The coins slide, due to gravity, toward a lower portion of the wheel housing 60. It should be apparent from FIG. 10 that the central wall portion 118 is at a higher elevation than is the outer wall portion 110. Thus except for the recessed area 132, the plateau 130 of the central wall portion 118 lies at the same elevation as the top surface of the separating wheel 62 which is accommodated in the wheel housing 60. This can be seen from FIG. 11. In contrast, the C-shaped recessed area 132 of the central wall portion 118 is at the same elevation as the wheel housing in an area where there is an aperture 82 extending through the separating wheel 62. This can be seen from FIG. 10A.

The difference in height between the central wall portion 118 and the outer wall 110 of the wheel housing defines a stationary rolling surface 136 against which an edge of a coin being sorted rolls as the coin is moved by the separating wheel 62 in a clockwise manner on the wheel housing until the coin falls through the aperture 114 designed to accommodate it. The rolling surface 136 has a width which is thinner than a thickness of the thinnest coin meant to be sorted.

As mentioned previously, the straighter trailing edge 92 of the separating wheel aperture 82 enables smaller coins, once they are picked up, to travel radially inwardly, i.e. centripetally, due to gravity so as to protrude through the slot 88 to the greatest extent possible. This enables the smaller coins to be sorted correctly. Forcing smaller coins to move centripetally establishes a relationship between a radially inner point of a coin, the sorting surface, namely the outer edge 124 of the aperture 114, and the stationary rolling surface 136.

Figure 12:
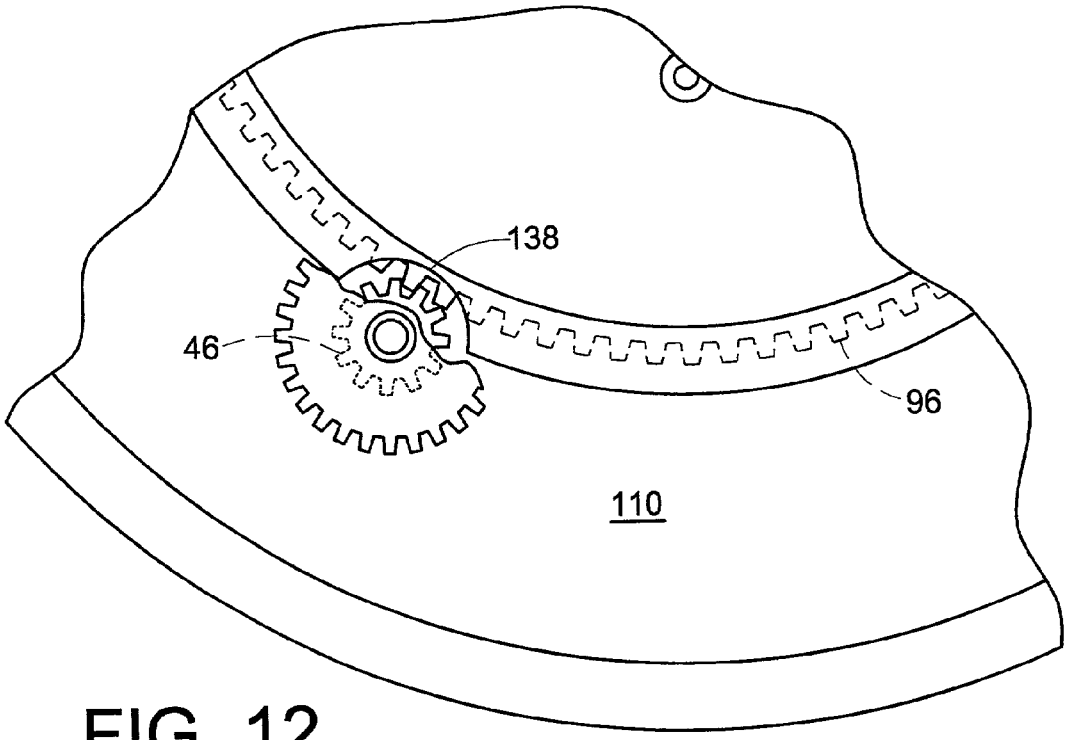
FIG. 12 is a greatly enlarged partial bottom plan view of the separating and sorting assembly of FIG. 6 with parts removed for clarity.

With reference now to FIG. 12, it can be seen that a slot 138 is located in the wheel housing 60. The slot enables a suitable one of the gears 46 to contact the gearing 96 of the separating wheel 62 in order to allow the separating wheel to be rotated when the separating wheel is mounted in the wheel housing 60. While gearing 96 is illustrated for the sorting wheel 60, it should be appreciated that the sorting wheel could also be rotated by other means, such as via a belt or a similar known arrangement.

Figure 9:
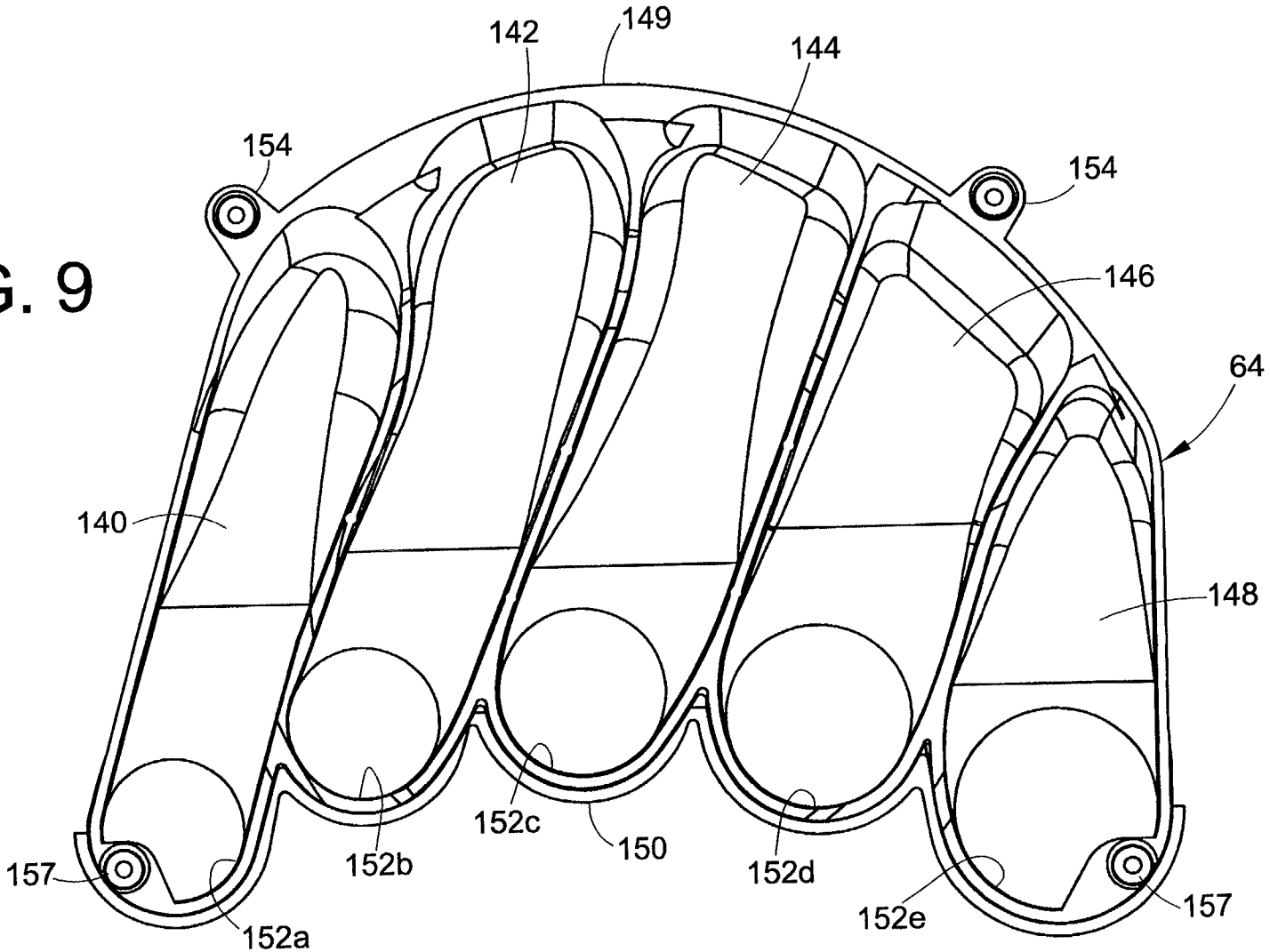
FIG. 9 is an enlarged top plan view of a coin slide of the coin bank of FIG. 1B.

With reference now to FIG. 9, the coin slide 64 is provided with five coin sliding surfaces 140–148. Each of the coin sliding surfaces is positioned beneath a respective one of the openings 114*a*–114*e*. The coin slide slopes from an upper end 149 to a lower end 150. Positioned at a lower end of each of the coin sliding surfaces 140–148 is a respective opening 152*a*–152*e*. It should be apparent that the several openings 152*a*–152*e* are of differing diameters, with the aperture 152*a* having the smallest diameter and the aperture 152*e* having the largest diameter. The diameters of the apertures 152*a*–152*e* are each slightly larger than the diameter of the coin meant to be accommodated in a respective one of the slides. The diameters of the apertures 152*a*–152*e* correspond with the widths of the openings 114*a*–114*e* in the wheel housing 60.

A pair of spaced ears 154 are located on the upper end 149 of the coin slide 64. These ears 154 cooperate with suitable ears 156 (FIG. 4) extending away from the skirt 112 of the wheel housing 60. Similarly, spaced posts 157 extend away from the lower end 150 of the coin slide adjacent the smallest and largest diameter apertures 152*a* and 152*e*. The posts 157 cooperate with ears 158 (FIG. 4) extending away from the skirt 112 of the wheel housing 60. Suitable fasteners, not illustrated, enable the coin slide 64 to be mounted beneath the wheel housing 60 via the cooperating ears 154 and 156 and the cooperating posts 157 and ears 158. Note that a center portion of the coin slide lower end 150 is somewhat recessed in relation to the two wings thereof to form a somewhat crescent shaped lower end 150. This shape allows the motor housing 48, 50 to be secured to the wheel housing while not interfering with the coin slide 64.

Figure 13:
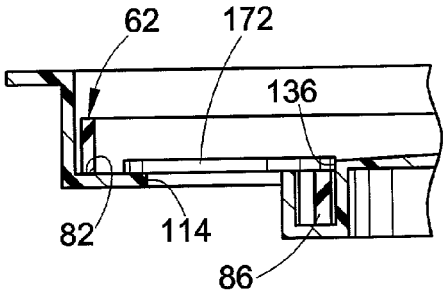
FIG. 13 is an enlarged cross-sectional view along line 13—13 of the coin separating and sorting assembly of FIG. 6 with a coin being held therein.

With reference now to FIG. 13, a coin 172 is shown being positioned in an aperture 82 of the sorting wheel 62. The coin abuts the rolling surface 136 of the wheel housing 60. The coin is supported along its radially inner portion by the flange 86 of the sorting wheel. However, the coin cannot fall through the aperture 114 because it has a diameter larger than the diameter of the aperture.

The separating wheel 62 and the wheel housing 60, as well as the coin slide 64, can be manufactured from a suitable conventional plastic material. Alternatively, they can be made of a suitable conventional metal.

The operation of the coin sorter according to the present invention is as follows. As coins are dropped into the funnel 68, they will fall through an aperture 160 at the center thereof and fall into the hopper 66 and onto the sorting wheel 62. As the motor 44 rotates the gears 46 in the gear train, the gears will engage the gearing 96 on the separating wheel 62 causing it to begin rotating in a clockwise direction. The coins thus being held in the cover or hopper 66 are moved and fall into respective ones of the apertures 82 in the separating wheel 62. As the wheel 60 rotates on the canted wheel housing 62, coins will slide radially inwardly in the apertures 82, due to gravity as a result of the angle at which the coin separator wheel is positioned in relation to a vertical axis, and contact the rolling surface 136. The coins will roll against this surface as the wheel 62 rotates and moves the coins over the wheel housing 60. As a coin held in an aperture 82 of the wheel travels over the several increasingly larger sized apertures 114*a*–114*e* in the wheel housing 60, the coin will fall through the correctly sized opening. The coin will fall into the associated one of the coin sliding surfaces 140–148. The coin will then travel down the slide and fall through the associated one of the apertures 152*a*–152*e*. Coins will thereafter fall into a respective one of the coin containers 36 and be stacked therein.

While the wheel housing 60 and separating wheel 62 are illustrated as being used in connection with a coin slide 64 and a coin sorter mechanism as shown in FIGS. 1A and 1B, it should be appreciated that the wheel housing and sorting wheel disclosed herein can be used in a large variety of other types of coin sorters having much different types of coin slides and coin receiving areas, not to mention means for storing the coins or dispensing the coins as may be required.

Figure 14:
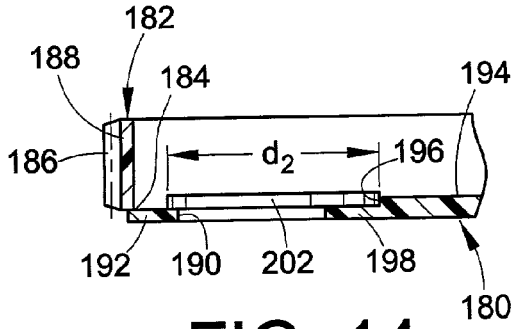
FIG. 14 is a cross-sectional view of a coin being held in a coin separating and sorting assembly according to a second embodiment of the present invention, wherein the coin is of sufficient diameter so as to resist falling through an aperture in a wheel housing.

With reference now to FIG. 14, according to another embodiment, there is provided a wheel housing 180 and a separating wheel 182. At least one aperture 184 is provided in the separating wheel 182. In this embodiment, a gear surface 186 is defined in an outer surface of a flange 188 of the separating wheel 182. Provided in the wheel housing 180, is at least one aperture 190. The wheel housing 180 has an outer rim 192 and an inner portion 194. Located in the inner portion is a coin rolling surface 196 and a coin support surface 198. As shown in FIG. 14, a relatively large diameter coin 202 is held in the aperture 184 of the separating wheel 182. The coin has a sufficiently large diameter that it cannot fall through the aperture 190 in the wheel housing 180.

Figure 15:
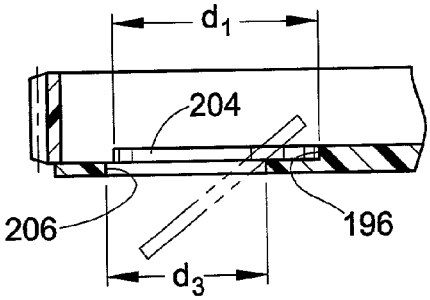
FIG. 15 is a cross-sectional view of the second embodiment of the coin separating and sorting assembly in accordance with FIG. 14 but with a coin of a sufficiently small diameter as to allow the coin to fall through the wheel housing aperture.

In contrast, in FIG. 15, a coin 204 is illustrated which is of a sufficiently smaller diameter that it can fall through the aperture 190. More specifically, the diameter $d_1$ of the coin 204 is smaller than the diameter $d_2$ of the coin 202. The distance between an inner surface 206 of the outer rim 192 and the coin rolling surface 196 of the wheel housing, defined as $d_3$, can be less than $d_1$ and $d_2$.

It should be apparent that a set of apertures is provided in both the separating wheel 182 and the wheel housing 180. The apertures 184 in the separating wheel 182 are all of the same size, whereas the apertures 190 in the wheel housing 180 are of progressively increasing width, as in the earlier embodiment. In all other respects, the second embodiment illustrated in FIGS. 14 and 15 is similar to the first embodiment illustrated in the earlier figures.

Figure 16:
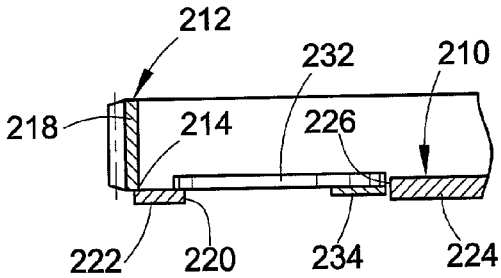
FIG. 16 is a cross-sectional view of a coin separating and sorting assembly according to a third embodiment of the present invention.

With reference now to FIG. 16, a third embodiment of the invention is there illustrated. In this embodiment, there is provided a wheel housing 210 and a separating wheel 212. Provided in the separating wheel is at least one aperture 214 which is located radially inwardly from a flange 218. Located in the wheel housing 210 is a set of apertures 220. The wheel housing includes an outer rim 222 and an inner portion 224 on which is defined a coin rolling surface 226. A coin 232 is held in the separating wheel aperture 214 and is supported by an inner toroidal flange 234 of the separating wheel 212. It should be apparent that in this embodiment, the coin support surface is part of the separating wheel 212, unlike the embodiment of FIGS. 14 and 15 where the coin support surface was part of the wheel housing.

The wheel housing and the separating wheel can be made of a suitable conventional thermoplastic material (as shown in the embodiment of FIGS. 14 and 15) or out of a suitable conventional metal (as shown in the embodiment of FIG. 16).

Figure 17:
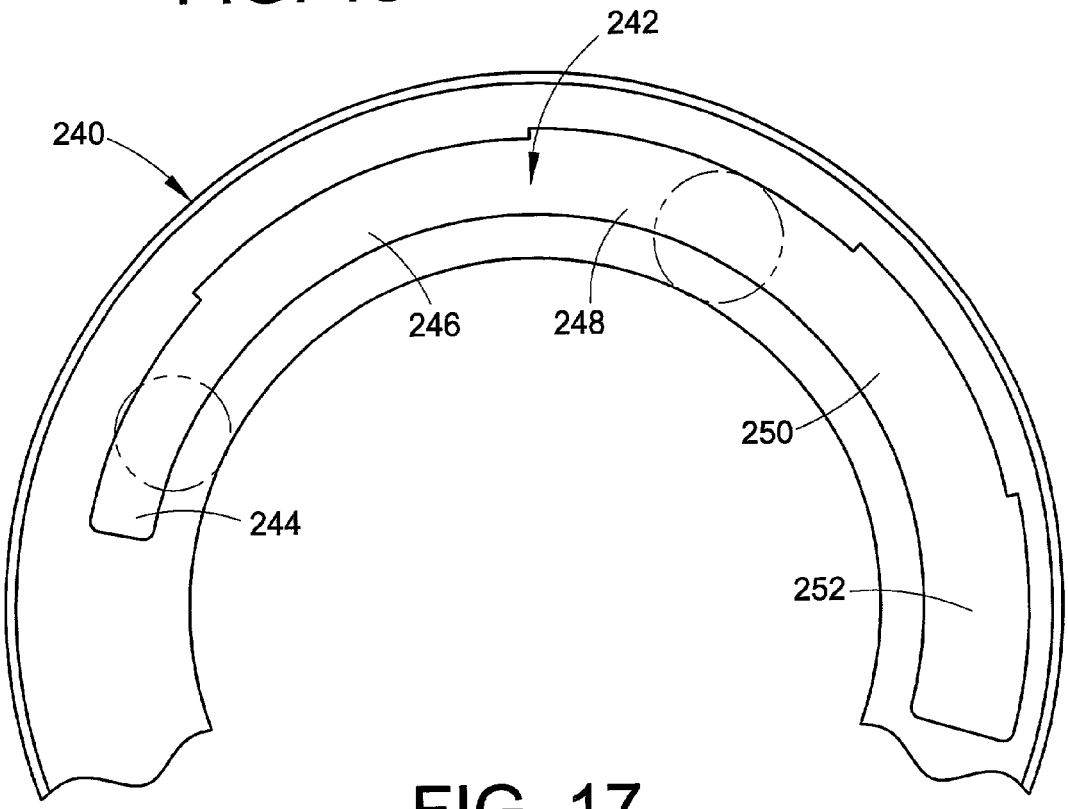
FIG. 17 is a partial top-plan view of a wheel housing according to a fourth embodiment of the present invention.

With reference now to FIG. 17, a fourth embodiment of the present invention includes a wheel housing 240 in which is provided an elongated opening 242 having a staggered set of widths. More particularly, the opening has a first width section 244, a second width section 246, a third width section 248, a fourth width section 250, and a fifth width section 252. Each of these sections will accommodate a particular diameter of a coin. Just as with the embodiment of FIG. 4, five different diameter coins can be sorted as they are moved by a rotating separating wheel (not shown) in relation to the stationary wheel housing 240. The smallest diameter coin will fall through the first section 244 of the elongated opening 242, whereas the largest diameter coin will fall through the fifth section 252 thereof. Thus, it should be appreciated that bridges separating the various coin sorting apertures, such as illustrated in FIG. 4, are not necessary for the correct functioning of the coin separating and sorting assembly according to the present invention.

Figure 18:
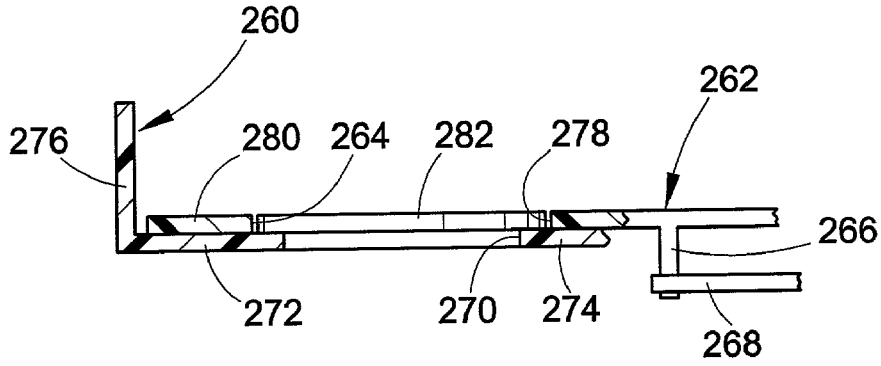
FIG. 18 is a cross-sectional view of a fifth embodiment of the coin separating and sorting assembly in accordance with the present invention.

With reference now to FIG. 18, a fifth embodiment of the present invention includes a wheel housing 260 on which is mounted a separating wheel 262. The separating wheel is provided with at least one aperture 264. Depending from a lower surface of the wheel 262 is a stem 266 around which is looped a suitable conventional belt 268 to allow the wheel 262 to be rotated. Located in the wheel housing 260 is a set of apertures 270. The wheel housing includes an outer portion 272 which is positioned radially outwardly of the apertures 270 and a radially inner portion 274. The wheel housing also includes a flange 276 extending away from the wheel housing outer portion 272. In this embodiment, a coin rolling surface 278 is provided by an inner periphery of the aperture 264 of the separating wheel 262. A coin support surface is provided by the wheel housing inner portion 274. It should also be noted that in this embodiment, the separating wheel has an outer portion 280 which is located radially outwardly of the at least one aperture 264. As in the previous embodiments, when a coin 282 encounters a wheel housing aperture 270 of suitable size, it will fall through the aperture.

Figure 19:
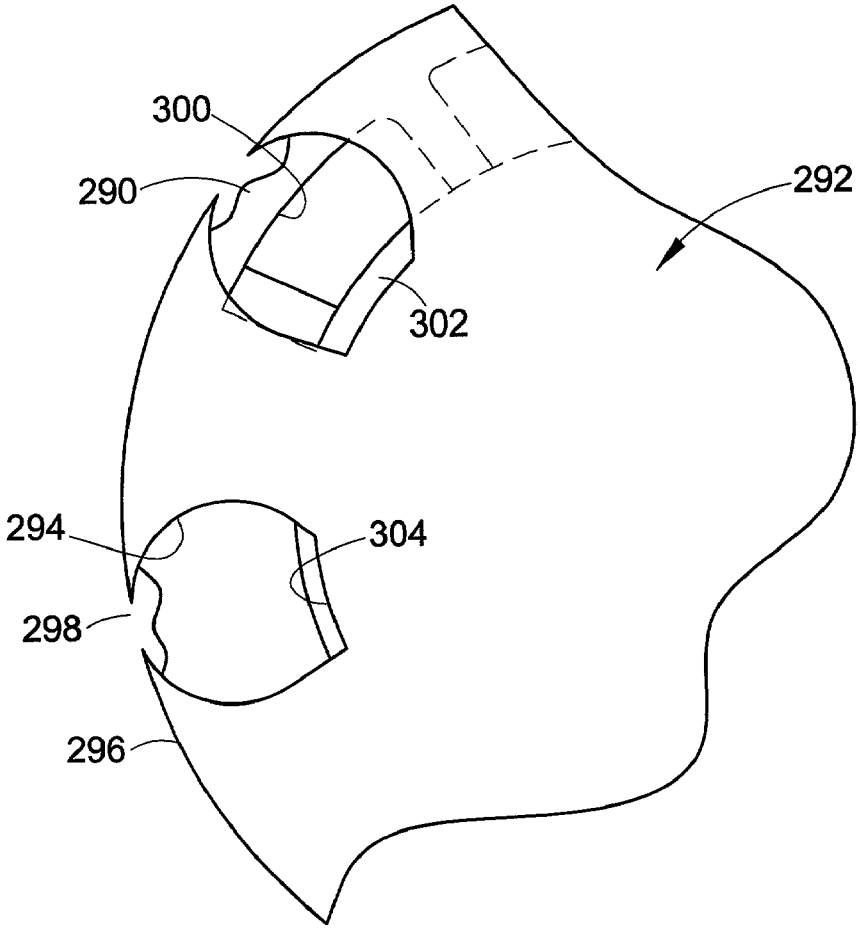
FIG. 19 is a partial top-plan view of a sorting wheel and a wheel housing according to a sixth embodiment of the present invention.

With reference now also to FIG. 19, in a sixth embodiment of the present invention a wheel housing 290 supports a separating wheel 292. The separating wheel includes at least two apertures 294. Unlike the embodiment of FIG. 18, the separating wheel apertures extend all the way to an outer periphery 296 of the wheel such that a gap 298 is defined at the intersection of the aperture 294 and the outer periphery 296. The wheel housing has at least one aperture 300 extending therethrough to allow passage of a coin of a desired diameter therethrough. In this embodiment, a coin support surface 302 is provided by an inner portion of the wheel housing 290 whereas a coin rolling surface 304 is provided by a radially inner wall of the wheel 292.

The invention has been described with reference to several embodiments. Obviously, modifications and alterations will occur to others upon a reading and understanding of the preceding specification. It is intended that the invention be construed as including all such modifications and alterations insofar as they come within the scope of the appended claims and the equivalents thereof.

Having now described the preferred embodiment, the invention is claimed to be:

1. A coin separating and sorting assembly comprising:

a separating wheel including at least one coin receiving aperture;

a wheel housing on which said separating wheel is supported, said wheel housing being oriented at an acute angle to a horizontal plane and comprising at least one sorting aperture which is sized to allow passage of a coin of a defined maximum diameter therethrough wherein the at least one coin receiving aperture selectively overlies the at least one sorting aperture;

a first coin support surface provided on the wheel housing; and, a second coin support surface defined on the wheel housing wherein said second coin support surface is oriented approximately perpendicular to said first coin support surface.

2. The assembly of claim 1 wherein said separating wheel comprises a set of gear teeth and further comprising a motor having an output shaft operably connected to said gear teeth of said separating wheel for driving said separating wheel.

3. The assembly of claim 1 wherein said wheel housing comprises a plurality of apertures, arranged in a size order.

4. The assembly of claim 3 wherein at least one of said apertures has a trailing edge with an angled surface.

5. The assembly of claim 1 wherein said wheel housing further comprises a central portion having a recessed area in an upper surface thereof.

6. A coin separating and sorting assembly comprising:

a separating wheel including at least one coin receiving aperture and a toroidal flange connected to said separating wheel and disposed radially outward of said at least one coin receiving aperture;

a wheel housing on which said separating wheel is supported, said wheel housing comprising at least one sorting aperture which is sized to allow passage of a coin of a defined maximum diameter therethrough wherein the at least one coin receiving aperture selectively overlies the at least one sorting aperture;

a first coin support surface provided on the wheel housing for supporting a face of an associated coin; and, a second coin support surface defined on the wheel housing for supporting an edge of the associated coin.

7. The assembly of claim 6 wherein said leading edge of each of said plurality of apertures of said separating wheel has a thickness slightly greater than a thickness of a thickest coin meant to be sorted.

8. The assembly of claim 6 wherein each of said plurality of apertures in said separating wheel has a diameter large enough to accommodate a diameter of the largest coin meant to be sorted and wherein a diameter of the largest coin meant to be sorted is smaller than twice the diameter of the smallest diameter coin meant to be sorted so that the two of the smallest diameter ones of the coins meant to be sorted cannot fit into a single aperture.

9. The assembly of claim 6 wherein each of said plurality of apertures and said separating wheel has a trailing edge with a tapered surface that is smaller in thickness than is a thickness of a thinnest coin meant to be sorted in order to prevent two of the coins from becoming stacked in a single aperture.

10. A coin separating and sorting assembly comprising:

a separating wheel including at least one coin receiving aperture;

a wheel housing on which said separating wheel is supported, said wheel housing being oriented at an acute angle to a horizontal plane and comprising at least one sorting aperture;

a first coin support surface provided on the wheel housing; and, a second coin support surface defined on the wheel housing, wherein a trailing edge of the at least one coin receiving aperture of the separating wheel is so shaped as to allow an associated coin held in said at least one coin receiving aperture to contact said second coin support surface before the associated coin reaches the at least one sorting aperture.

11. The assembly of claim 10 wherein said trailing edge has a tapered surface that is smaller in thickness than is a thickness of a thinnest coin meant to be sorted in order to prevent two of the coins from becoming stacked in a single aperture.

12. The assembly of claim 11 wherein said wheel housing comprises a plurality of apertures arranged in order of increasing size.

13. The assembly of claim 11 wherein a leading edge of said at least one coin receiving aperture of the separating wheel has a thickness slightly greater than a thickness of a thickest coin meant to be sorted.

14. A coin separating and sorting assembly comprising:

a separating member including at least one coin receiving aperture;

a housing, oriented at an acute angle to a horizontal plane, on which said separating member is movably supported, said housing comprising at least one coin sorting aperture, wherein said at least one coin receiving aperture selectively overlies said at least one coin sorting aperture;

a stationary coin support surface provided on said housing; and a stationary coin rolling surface provided on said housing.

15. The assembly of claim 14 wherein said separating member comprises a plurality of spaced coin receiving apertures.

16. The assembly of claim 14 wherein said housing comprises a plurality of coin sorting apertures of different sizes, each coin sorting aperture being sized to allow a coin of a defined maximum diameter therethrough.

17. The assembly of claim 16 wherein said plurality of coin sorting apertures are spaced from each other.

18. The assembly of claim 16 wherein said plurality of coin sorting apertures each include a radially inner edge that is equidistant from a transverse axis of said housing.

19. The assembly of claim 18 wherein said plurality of coin sorting apertures each include a radially outer edge that is located successively further away from said axis, in a direction of movement of said separating member.

20. The assembly of claim 14 wherein said housing includes a transverse axis, said coin rolling surface is spaced from said axis and said coin support surface is located radially outwardly of said coin rolling surface.

21. The assembly of claim 20 wherein said separating member comprises a wheel.

22. A coin bank comprising:

a coin hopper; and, a coin separating and sorting assembly located beneath said coin hopper, said separating and sorting assembly comprising:

a separating plate including a plurality of coin receiving apertures each having an identical shape and each including a substantially constant diameter and a toroidal flange of one piece with and extending away from a plane of said separating plate, and a housing on which said separating plate is movably mounted, said housing including a wall with an upper portion, a lower portion and four coin sorting apertures located on the upper portion, one each for sorting associated dimes, pennies, nickels and quarters, wherein each of said coin receiving aperture, selectively overlies each of said four coin sorting apertures whereby an associated coin to be sorted drops from a respective coin receiving aperture into an appropriately sized one of said four coin sorting apertures, and wherein each associated coin to be sorted moves toward an axis of rotation of said separating plate prior to each coin receiving opening overlying a first of the four coin sorting apertures.

23. The bank of claim 22 wherein said separating plate is rotatably mounted on said housing.

24. The bank of claim 23 further comprising a mechanism for rotating said separating plate on said housing.

25. The bank of claim 22 wherein said separating plate is toroidally shaped.

26. The bank of claim 25 wherein said separating plate includes a central opening which is larger in diameter than is a diameter of said at least one coin receiving aperture.

27. A coin separating and sorting assembly comprising:

a ring-shaped separating wheel including at least one coin receiving aperture and a toroidal flange extending away from a plane of said separating wheel; and, a wheel housing on which said separating wheel is supported, said wheel housing including at least one coin sorting aperture.

28. The assembly of claim 27 wherein said separating wheel is rotatably mounted on said wheel housing.

29. The assembly of claim 28 further comprising a mechanism for rotating said separating wheel on said wheel housing.

30. The assembly of claim 27 wherein an inner periphery of said separating wheel includes at least one slot which is aligned with said at least one coin receiving aperture to allow an edge of an associated coin to protrude therethrough.

31. The assembly of claim 30 wherein said separating wheel includes a central opening which is larger in radius than is a diameter of said at least one coin receiving aperture.

32. The assembly of claim 27 wherein said toroidal flange is located radially outward from said at least one coin receiving aperture.

33. The assembly of claim 27 wherein a plurality of spaced coin receiving apertures are defined in said separating wheel.

34. The assembly of claim 33 wherein a plurality of coin sorting apertures are defined in said wheel housing.

35. The assembly of claim 34 wherein said coin sorting apertures are spaced from each other.

36. A coin bank comprising:

a housing;

a coin separating and sorting assembly mounted in said housing, said assembly comprising:

a separating wheel including at least one coin receiving aperture, a wheel housing on which said separating wheel is supported, said wheel housing comprising a plurality of coin sorting apertures of different sizes, each aperture being sized to allow passage of an associated coin of a defined maximum diameter therethrough, wherein said at least one coin receiving aperture of said separating wheel selectively overlies each of said plurality of coin sorting apertures to allow an associated coin to drop from said at least one coin receiving aperture into an appropriately sized one of said plurality of coin sorting apertures, wherein at least one of said plurality of coin sorting apertures includes a tapered wall;

a drawer slidably mounted in said housing; and at least one coin tube being supported by said drawer and being removable therefrom.

37. A coin bank comprising:

a housing;

a coin separating and sorting assembly mounted in said housing, said assembly comprising:

a separating wheel including at least one coin receiving aperture, a wheel housing on which said separating wheel is supported, said wheel housing comprising a coin sorting face including a plurality of coin sorting apertures of different sizes, each aperture being sized to allow passage of an associated coin of a defined maximum diameter therethrough, wherein said coin sorting face is located directly beneath said separating wheel such that said at least one coin receiving aperture intermittently overlies each of said plurality of coin sorting apertures; and a plurality of coin tubes, each of which is in communication with a respective one of said plurality of coin sorting apertures, said plurality of coin tubes being selectively held in a drawer slidably mounted to said housing.

38. A coin bank comprising:

a housing;

a coin separating and sorting assembly mounted in said housing, said assembly comprising:

a separating wheel including at least one coin receiving aperture, and a wheel housing on which said separating wheel is supported, said wheel housing comprising a coin sorting face oriented at an acute angle in relation to a horizontal plane, said coin sorting face including a plurality of coin sorting apertures of different sizes; and, a plurality of coin tubes, each of which is in communication with a respective one of said plurality of coin sorting apertures, wherein said plurality of coin tubes is oriented approximately perpendicular to a plane of said wheel housing planar face.

39. A coin separating and sorting assembly comprising:

a separating wheel including at least one coin receiving aperture; and, a wheel housing on which said separating wheel is rotatably supported, said wheel housing including:

a first portion located in a first plane, said first portion being approximately ring-shaped and including at least one coin sorting aperture, and a second portion located in a second plane, spaced away from said first plane, said second portion being encircled by said first portion.

40. The assembly of claim 39 wherein said first portion comprises a plurality of coin sorting apertures of different sizes.

41. The assembly of claim 39 wherein said second plane is located above said first plane.

42. The assembly of claim 39 wherein said second portion is approximately circular.

43. The assembly of claim 39 wherein said wheel housing further comprises a flange located radially outwardly of said first portion and extending away from said first plane.

44. The assembly of claim 39 wherein said wheel housing further comprises a groove located between said first portion and said second portion, said groove accommodating a portion of said separating wheel.

45. A coin bank comprising:

a coin hopper;

a coin slide positioned below said coin hopper; and, a coin separating and sorting assembly located between said coin hopper and said coin slide, said coin separating and sorting assembly comprising:

a separating wheel including at least one coin receiving aperture and a toroidal flange extending away from a face of said separating wheel wherein said toroidal flange fully encloses an outer perimeter of said at least one coin receiving aperture, and a wheel housing on which said separating wheel is rotatably supported, said wheel housing being oriented at an acute angle in relation to a horizontal plane and including a plurality of coin sorting apertures of different sizes, said wheel housing including a lower section and an upper section, wherein said plurality of coin sorting apertures are located in said wheel housing upper section.

46. The bank of claim 45 wherein said separating wheel further comprises a second toroidal flange having a set of gear teeth.

47. The bank of claim 46 further comprising a motor having an output shaft operably connected to said gear teeth of said toroidal flange for driving the separating wheel.

48. The bank of claim 47 further comprising a gear train positioned between said output shaft and said gear teeth of said toroidal shaft, one gear of said gear train being fastened on said output shaft and another gear of said gear train engaging said gear teeth of said toroidal flange.

49. The bank of claim 46 wherein said wheel housing comprises a toroidal channel which includes an opening through which said gear teeth of said toroidal flange can be accessed.

50. A coin bank comprising:

a coin hopper;

a sorted coin container positioned below said coin hopper; and, a coin separating and sorting assembly located between said coin hopper and said sorted coin container, said coin separating and sorting assembly comprising:

a ring-shaped separating wheel including at least one coin receiving aperture, a wheel housing on which said separating wheel is rotatably supported, said wheel housing comprising a plurality of sorting apertures of different sizes, each aperture being sized to allow passage of an associated coin of a defined maximum diameter therethrough.

51. The bank of claim 50 wherein said wheel housing apertures are arranged in a size order.

52. The bank of claim 50 wherein at least one of said sorting apertures has a trailing edge with an angled surface.

53. The bank of claim 50 wherein said wheel housing further comprises a central portion located radially inwardly from said plurality of sorting apertures, said central portion having a recessed area in an upper surface thereof.

* * * * *